US005701358A

United States Patent [19]

Larsen et al.

[11] Patent Number: 5,701,358

[45] Date of Patent: Dec. 23, 1997

[54] ISOBARIC LOUDSPEAKER

[76] Inventors: John T. Larsen, 1443 Foxboro; James R. Larsen, 912 Windsor Ct., both of Blue Springs, Mo. 64015

[21] Appl. No.: 548,027

[22] Filed: Oct. 25, 1995

Related U.S. Application Data

[63] Continuation-in-part of Ser. No. 277,651, Jul. 5, 1994, abandoned.

[51] Int. Cl.[6] ..... H04R 25/00

[52] U.S. Cl. ..... 381/202; 381/194; 381/199

[58] Field of Search ..... 181/171, 172, 181/164, 165, 147; 381/194, 195, 199, 202

[56] References Cited

U.S. PATENT DOCUMENTS

| | | | |
|---|---|---|---|
| 3,453,400 | 7/1969 | Coen | 381/201 |
| 3,477,540 | 11/1969 | Rizo-Patron | 181/31 |
| 3,925,626 | 12/1975 | Stallings | 179/181 |
| 4,016,953 | 4/1977 | Butler | 181/144 |
| 4,190,746 | 2/1980 | Harwood et al. | 179/181 |
| 4,425,482 | 1/1984 | Bordelon et al. | 179/120 |
| 4,466,505 | 8/1984 | Ritter | 181/144 |
| 4,472,605 | 9/1984 | Klein | 381/88 |
| 4,584,439 | 4/1986 | Paddock | 179/117 |
| 4,598,789 | 7/1986 | Ritter | 181/144 |
| 4,665,550 | 5/1987 | Haas | 381/182 |
| 4,829,581 | 5/1989 | Nieuwendijk et al. | 381/202 |
| 4,903,308 | 2/1990 | Paddock et al. | 179/115.5 PV |
| 4,989,254 | 1/1991 | Amalaha | 381/202 |
| 5,014,321 | 5/1991 | Klein | 381/190 |
| 5,119,431 | 6/1992 | Hamby | 381/199 |
| 5,230,021 | 7/1993 | Paddock | 381/202 |
| 5,249,237 | 9/1993 | Paddock . | |
| 5,253,301 | 10/1993 | Sakamota et al. | 381/188 |
| 5,499,729 | 3/1996 | Greenwood et al. | 215/11.5 |

FOREIGN PATENT DOCUMENTS

| | | |
|---|---|---|
| 0390123 | 3/1990 | European Pat. Off. . |
| 2314725 | 3/1973 | Germany . |
| 3306801 | 2/1983 | Germany . |

*Primary Examiner*—Curtis Kuntz
*Assistant Examiner*—Rexford N. Barnie
*Attorney, Agent, or Firm*—Hovey, Williams, Timmons & Collins

[57] ABSTRACT

An isobaric loudspeaker for use in audio systems is disclosed. The isobaric loudspeaker includes a central mounting bracket, a pair of opposed first and second diaphragm assemblies attached to the mounting bracket, and a single magnet assembly positioned between the first and second diaphragm assemblies for providing a magnetic field in the vicinity of the voice coils of both of the diaphragm assemblies. The magnet assembly presents a central hollow chamber extending between and connecting the opposed speaker assemblies for permitting air to pass freely between the diaphragms of the opposed speaker assemblies.

15 Claims, 6 Drawing Sheets

ISOBARIC LOUDSPEAKER

RELATED APPLICATION

The present application is a Continuation-In-Part of U.S. patent application Ser. No. 08/277,651 filed Jul. 5, 1994, now abandoned entitled ISOBARIC LOUDSPEAKER.

BACKGROUND OF THE INVENTION

1. Field of the Invention

The present invention is related to loudspeakers, and more specifically to an isobaric "push-pull" style loudspeaker with improved fullrange-frequency response characteristics. This 360° isobaric loudspeaker includes a pair of opposed dome-shaped diaphragm assemblies. These diaphragm assemblies are detachable and consist of a diaphragm, voice coil, spider gear, foam surround and a set of suspension towers. A single magnet assembly is positioned between the diaphragm assemblies. The magnet assembly includes a single ring-shaped pole piece with radial magnet flux grooves surrounding the poles on opposite sides. A hollow chamber is created in the center of the magnet assembly that extends between the diaphragm assemblies for creating a zone of equalized high pressure between the two diaphragm assemblies.

2. Description of the Prior Art

Loudspeakers convert electrical energy representative of sound or music to acoustical energy. The basic design of loudspeakers is based on the theory of electromagnetism and has not changed significantly since the 1920's.

A typical loudspeaker is a complex device consisting of several important systems. The driver consists of a frame housing, the cone and voice coil (the moving system), the surround and the spider (the suspension system), and a permanent magnet system. The cone (diaphragm) is connected to a cylinder (the former) around which a coil of enameled wire (voice coil) is wrapped. The signal coming from the amplifier/crossover passes through the voice coil, which is an inductor. It is called the voice coil because it causes the cone to move the air in front of the driver, thus giving the driver a voice. The voice coil is centered in a narrow gap (radial magnet flux groove) through which the permanent magnet's field passes. One task of the surround, which suspends the cone on the basket, and the spider gear, which looks like a web, is to keep the voice coil centered in this narrow gap.

The cone moves because of a dynamic interaction between two magnet fields, one coming from the permanent magnet and the other created by the signal voltage applied to the voice coil. The permanent magnet's field does not change direction. It remains highly concentrated and constant in the narrow gap between the voice coil and the magnet. When an incoming signal produces a voice-coil magnetic field that adds to and subtracts from the stationery field, the voice coil and the attached cone move forward. When the voice-coil signal polarity reverses, the voice coil field reverses. Thus, the voice coil and the attached cone move forward and backward in accordance with the varying polarity of the signal applied to the voice coil. The oscillations of the diaphragm closely follow the variations in the applied electrical signal to set up sound waves.

Modern loudspeakers often include a plurality of loudspeakers each designed to cover a distinct frequency range within the audible frequency range of approximately 30–16,000 Hz. For example, a loudspeaker system may include a woofer covering the low frequency range (bass), a mid-range frequency, and a small tweeter covering the high-range frequency band (treble).

Many stereo enthusiasts are not satisfied with conventional loudspeakers and continually seek a speaker with improved frequency response that more realistically reproduces the range of audible sound.

One type of prior art loudspeaker is an isobaric push-pull sub-woofer. It is constructed by bolting two conventional low frequency loudspeakers of the same size and make together in a face-to-face isobaric configuration. This face-to-face configuration produces improved low frequency response. There are additional benefits from using the push-pull technique. The voice coil in one driver moves toward its permanent magnet as the second driver's voice coil moves away from its magnet. The result is that asymmetric nonlinearities, such as those caused by a single voice coil moving through a magnetic field of uneven strength or nonlinearities due to suspension system irregularities are eliminated. In effect, second-order harmonic distortion is greatly reduced.

Despite these improvements, the isobaric push-pull loudspeaker still suffers from several distinct disadvantages. For example, since the diaphragms of these loudspeakers are positioned face-to-face their voice coils must be driven out-of-phase to prevent diaphragm collision and sound cancellation.

Another limitation of these face-to-face sub-woofers is that they are inefficient because they have heavy magnets and cone support structures that obstruct much of the sound that radiates from the cones. Additionally, they are expensive because their design duplicates all of the components of a conventional loudspeaker.

Another limitation of face-to-face sub-woofers is that they offer limited crossover capabilities. Crossover is the overlap of frequencies provided by two separate loudspeakers. An optimum loudspeaker system includes loudspeakers which cover frequency ranges which overlap to a small degree to improve the transition from one frequency range to another. Face-to-face sub-woofer loudspeakers merely consist of two identical loudspeakers bolted together; therefore, each loudspeaker has the same dynamic frequency range. Accordingly, neither loudspeaker provides crossover to a different frequency range.

A further limitation of face-to-face sub-woofers is that since their diaphragms are mounted face-to-face, they must be mounted in enclosures or baffles of exacting dimensions to enhance sound radiation and to prevent the loudspeakers from canceling each other out.

Speakers having opposed dome-shaped diaphragms rather than face-to-face are known in the art. However, loudspeakers of this type are actually two conventional transducers bolted back-to-back with their cones pushing against a spherical body that is connected to a base plate. The pole pieces of these conventional transducers are solid and prevent the passage of air between the two transducers and thus prevent the formation of a high pressure zone between the loudspeaker's actual diaphragms. As discussed in detail below, the lack of a high pressure zone reduces the performance of those prior art 360° loudspeakers.

SUMMARY OF THE INVENTION

The present invention overcomes the problems outlined above and provides an improved free air 360° loudspeaker. More particularly, the present invention provides an isobaric loudspeaker with superior frequency response that does not suffer from sound cancellation, does not require a baffle and is more efficient than prior art sub-woofer loudspeakers and 360° loudspeakers.

One preferred embodiment of the isobaric loudspeaker broadly includes: a pair of diaphragm assemblies each including an outer diaphragm and a voice coil for driving the outer diaphragm; mounting structure for mounting the diaphragm assemblies in an opposed relationship; and a magnet assembly positioned between the opposed diaphragm assemblies for providing a magnetic flux in the vicinity of both of the diaphragm assemblies. Advantageously, the magnet assembly presents a hollow chamber extending entirely between the opposed diaphragm assemblies for permitting air to pass between the outer diaphragms of the two diaphragm assemblies. This creates a high pressure chamber in the center of the loudspeaker.

In a midrange-midbase form, each diaphragm assembly also includes an inner diaphragm positioned within the outer diaphragm and over one open end of the high pressure chamber, increasing the high-end of the loudspeaker. This inner diaphragm generates additional sound waves and increases the pressure in the high pressure chamber. Both the inner and outer diaphragms are preferably dome-shaped, and the outer diaphragm may include a funnel-shaped vortex extending inwardly towards the inner diaphragm.

By constructing an isobaric loudspeaker in accordance with the present invention, numerous advantages are realized. For example, applicants have discovered that the frequency response of loudspeakers, and particularly subwoofers, is improved by creating a zone of high air pressure inside the loudspeakers. The present invention provides for an isobaric loudspeaker including structure for creating this high pressure zone.

Particularly, by providing a magnet assembly having a hollow chamber extending between the diaphragm assemblies, the loudspeaker permits air to pass between the outer dome-shaped diaphragms. This creates an equalized zone of high pressure between the diaphragms. Additionally, by providing each diaphragm assembly with an inner diaphragm positioned over one open end of the high pressure chamber, the pressure within this high pressure zone can be increased, gaining higher frequency response from the loudspeaker.

Another advantage of the present invention is that the two diaphragm assemblies may be sized independently of one another to cover distinct frequency ranges. Moreover, the diaphragms may be constructed of a variety of materials to alter the frequency response of the loudspeakers. This allows for superior crossover capabilities because each diaphragm assembly can be independently sized to cover a distinct frequency range.

A further advantage of the present invention is that the isobaric qualities of the loudspeaker eliminate the need for a baffle or enclosure. Additionally, many of the components of conventional isobaric loudspeakers are shared by the two opposed diaphragm assemblies, thus reducing the space, weight and cost of the loudspeaker.

Another advantage of the present advantage is that sound cancellation is reduced or eliminated and sound dispersement is provided in a 360 degree direction because the diaphragms are positioned in an opposed relationship rather than face-to-face.

Another advantage of the 360° isobaric loudspeaker is its modular design. It has been constructed in a manner in which the diaphragm assemblies can be removed. This is possible because the magnet assembly is used as the speaker's support structure. The diaphragm assemblies are constructed in a manner in which they can be detached by the removal of six screws. The screws are located on the suspension towers and extend through the towers to the magnet assembly, where threaded holes are positioned there to accept the screws. The diaphragm assemblies consist of a diaphragm, diaphragm mounting plate, voice coil, foam surround, spider gear, a suspension tower, and a set of negative and positive terminals.

The suspension towers are designed in a "stair-stepped" fashion. The lower step of the tower is utilized by the spider gear which in turn suspends the voice coil in the magnet assemblies radial magnetic flux groove. At the upper axial end of the voice coil a diaphragm mounting plate. It has three functions. The first function is to keep coil former true. It's second function is to provide a mounting area for the diaphragm, which in turn connects the coil and diaphragm together in a rigid fashion. It's third function is to facilitate the securement of the inner axial end of the foam surround. Then the foam surround outer axial end is secured to the top step of the suspension tower. Thus, providing an adequate suspension system for the coil/diaphragm assembly.

The easy removal of the diaphragm assemblies is advantageous in several ways. For example, if a diaphragm is damaged in operation (blown) it can be changed out with a new assembly by the removal of six screws. Also, the speakers performance can be altered by the use of a new assembly with perhaps a stronger voice coil or stiffer suspension system whereas it could handle more power.

BRIEF DESCRIPTION OF THE DRAWINGS FIGURES

The preferred embodiments of the present invention are described in detail below with reference to the attached drawing figures, wherein.

DETAILED DESCRIPTION OF THE PREFERRED EMBODIMENTS

Figure 6:
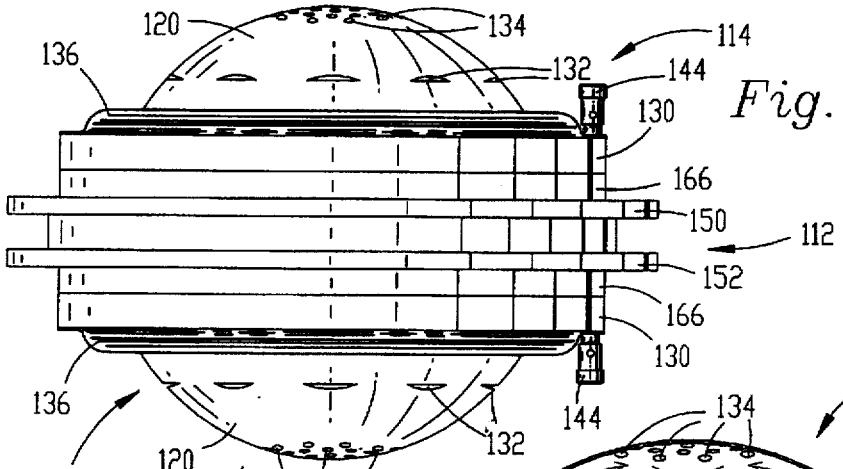
FIG. 6 is a side view of an isobaric loudspeaker apparatus constructed in accordance with a second preferred embodiment of the invention.
Figure 8:
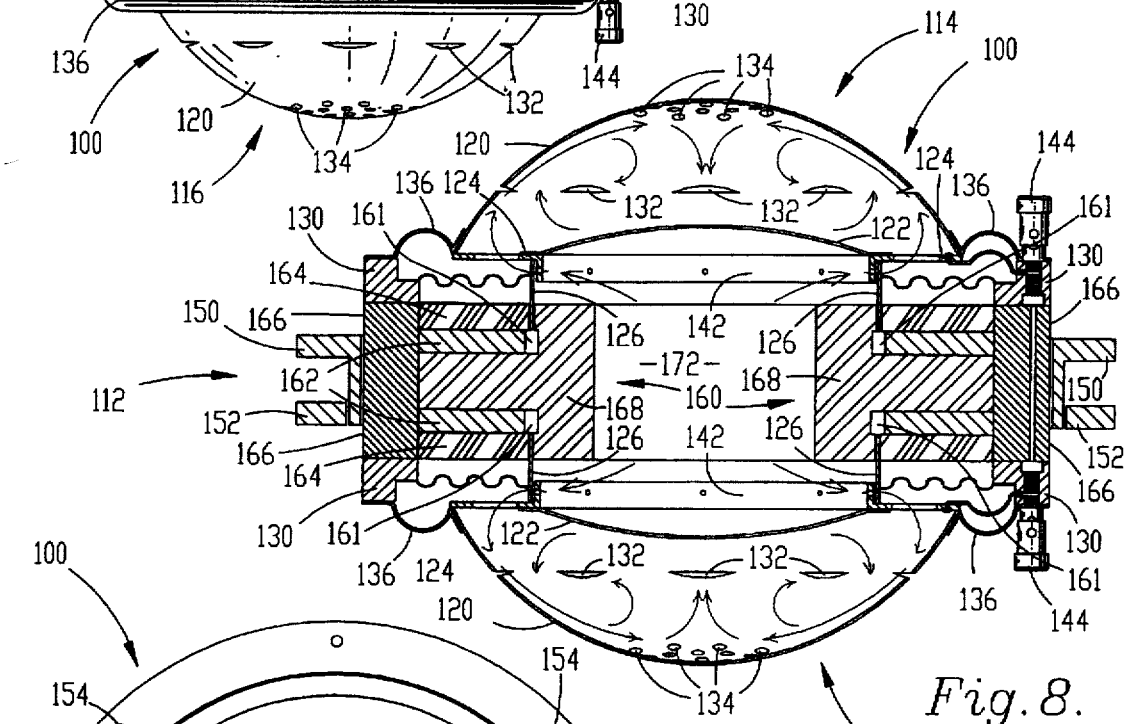
FIG. 8 is a side section view of the loudspeaker apparatus of the second embodiment.
Figure 7:
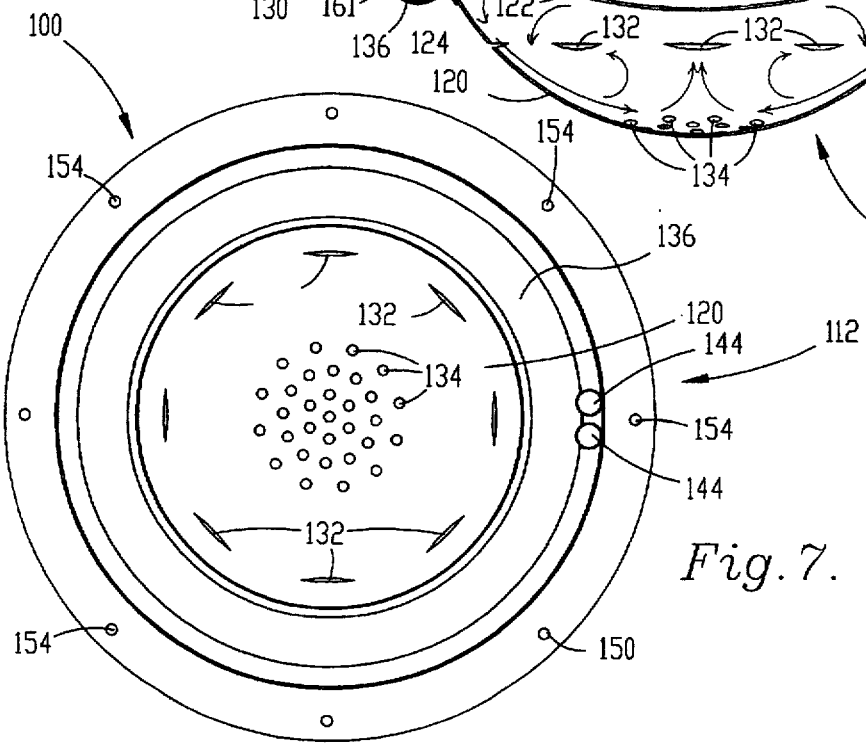
FIG. 7 is a top view of the loudspeaker apparatus of the second embodiment.
Figure 14:
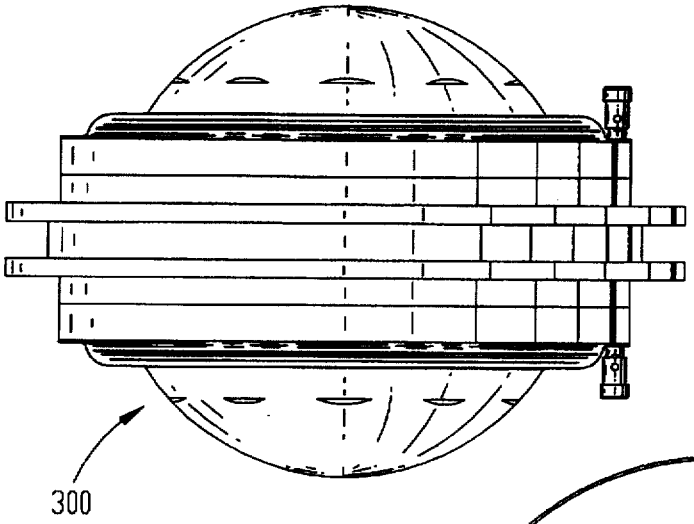
FIG. 14 is a perspective view of an isobaric loudspeaker apparatus constructed in accordance with a fourth preferred embodiment of the invention.
Figure 16:
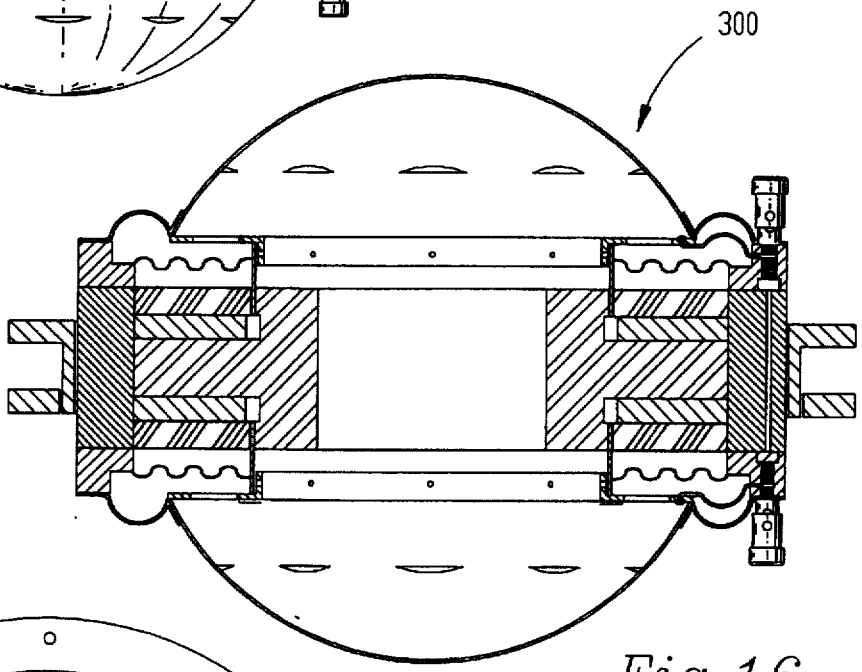
FIG. 16 is a side section view of the loudspeaker apparatus of the fourth embodiment.
Figure 15:
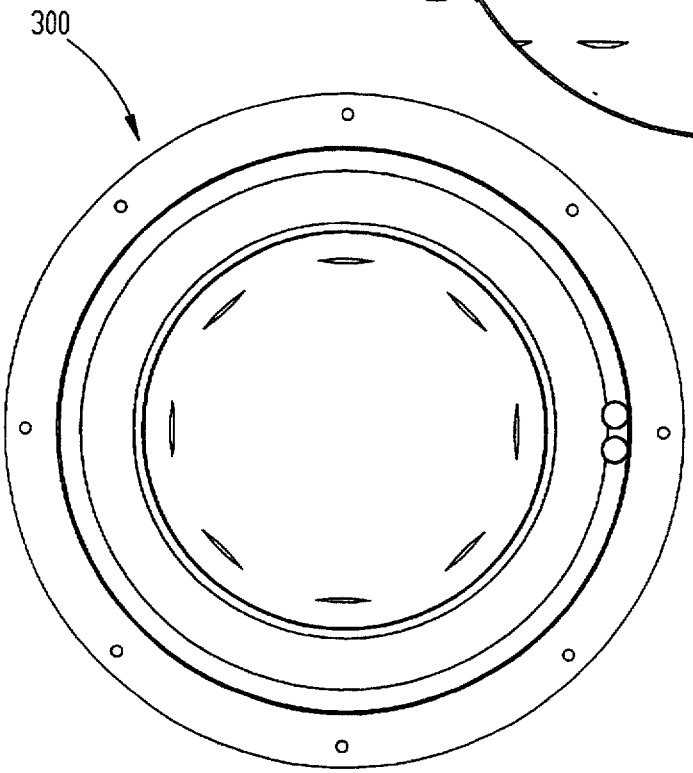
FIG. 15 is a top view of the loudspeaker apparatus of the fourth embodiment.

The present invention includes several preferred embodiments of an isobaric loudspeaker apparatus. A first embodiment is illustrated in FIGS. 1–5; a second embodiment is illustrated in FIGS. 6–8; a third embodiment is illustrated in FIGS. 9–13; and a fourth embodiment is illustrated in FIGS. 14–16. Each of these embodiments are discussed separately below.

I. Embodiment of FIGS. 1–5

Figure 1:
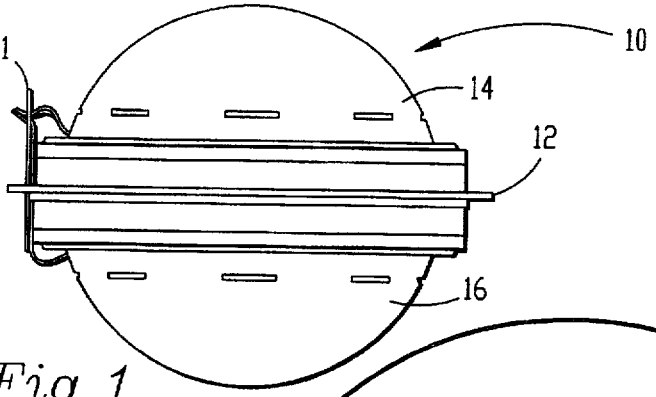
FIG. 1 is a side view of an isobaric loudspeaker apparatus constructed in accordance with a first preferred embodiment of the invention.
Figure 3:
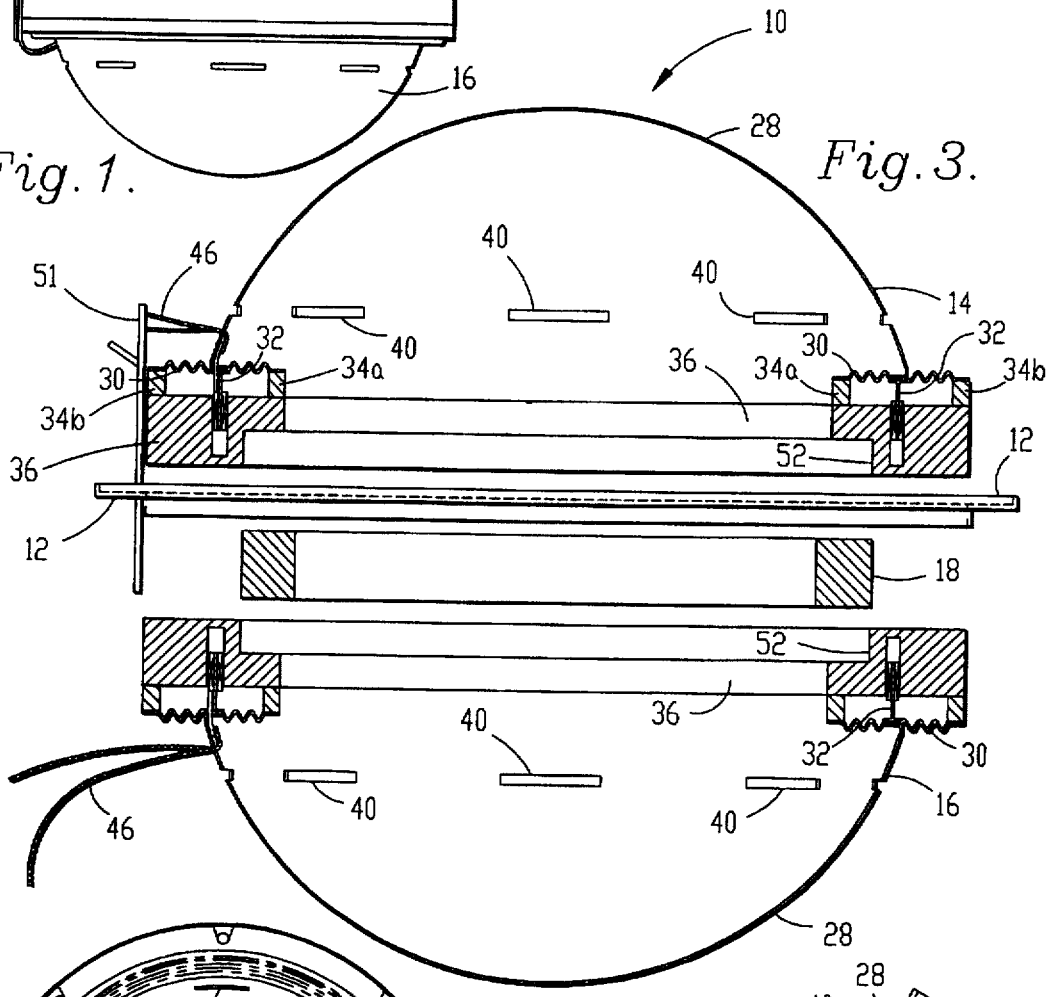
FIG. 3 is a partially exploded view of the loudspeaker apparatus of the first embodiment.

As best illustrated in FIG. 3, the first embodiment of isobaric loudspeaker apparatus 10 broadly includes central mounting bracket 12, opposed first and second diaphragm assemblies 14 and 16, and a single permanent magnet 18 positioned between first and second diaphragm assemblies 14 and 16.

Figure 4:
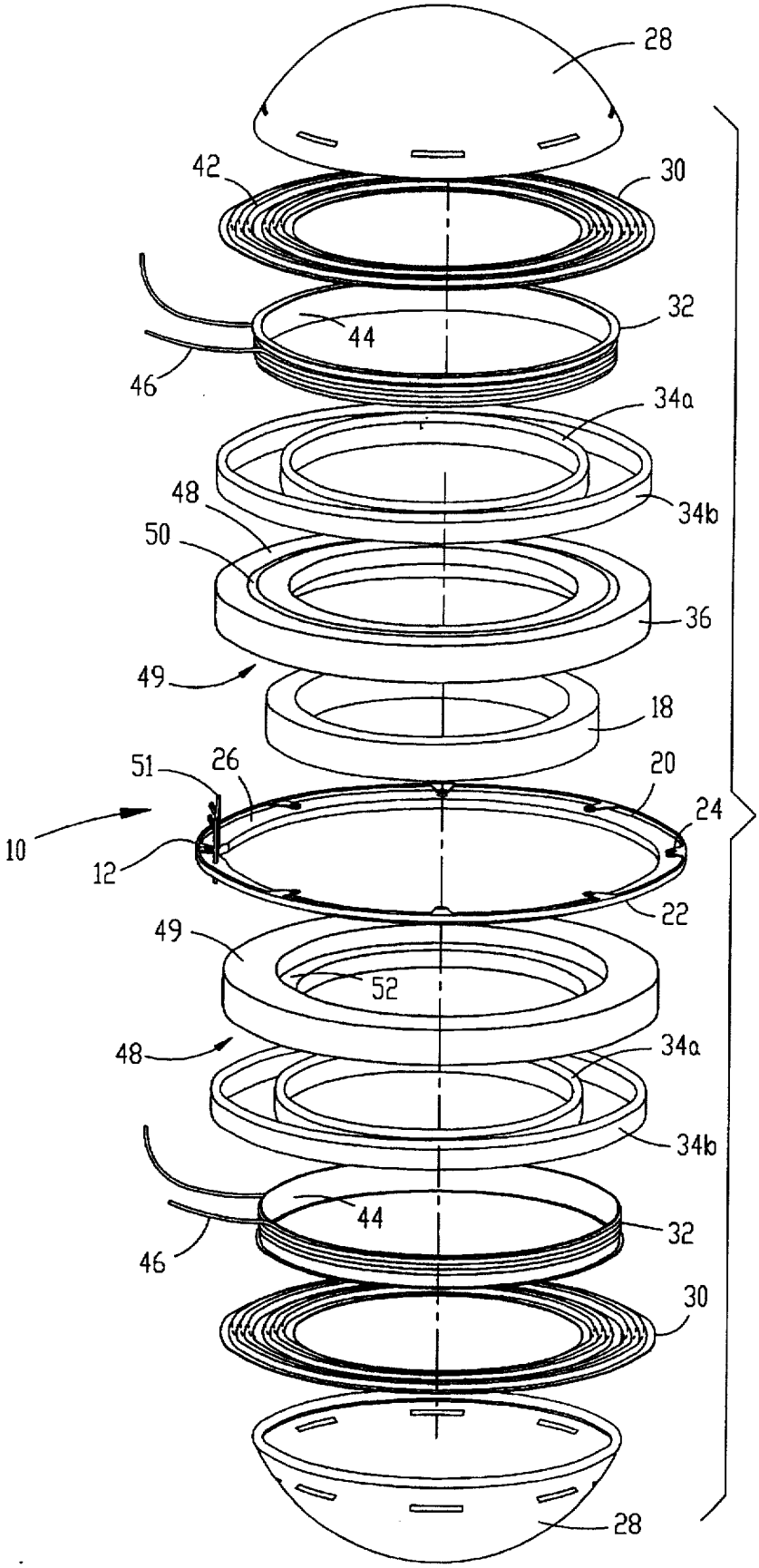
FIG. 4 is an exploded view of the loudspeaker apparatus of the second embodiment.

In more detail, central mounting bracket 12 is provided for supporting the remaining elements of isobaric loudspeaker 10. As best illustrated in FIG. 4, central mounting bracket 12 is preferably ring-shaped and presents opposed axial ends 20 and 22. Axial end 20 supports the components of first diaphragm assembly 14, whereas axial end 22 supports the components of second diaphragm assembly 16.

Figure 2:
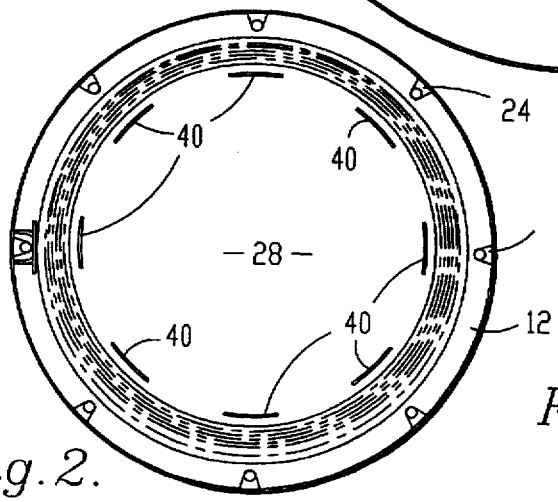
FIG. 2 is a top view of the loudspeaker apparatus of the first embodiment.

As best illustrated in FIG. 2, mounting bracket 12 includes a plurality of screw or bolt holes 24 extending parallel to its axis for receiving conventional screws or bolts for mounting loudspeaker apparatus 10 to a backboard or mounting plate. In preferred forms, a cardboard or rubber gasket 26 may be secured to each axial end 20 and 22 of bracket 12 to facilitate the securement of first and second diaphragm assemblies 14 and 16 to bracket 12.

As best illustrated in FIG. 4, each diaphragm assembly 14 and 16 includes diaphragm or reflex dome 28, accordion edge suspension 30, voice coil 32, suspension towers **34*a* and 34*b*, and magnetic flux ring 36. In preferred forms, the components of diaphragm assemblies 14 and 16** are substantial identical, thus only one diaphragm assembly is described in detail herein.

Reflex dome 28 is provided for setting up sound waves in response to vibration of voice coil 32 and can be formed of a variety of materials, such as polypropylene. As illustrated in FIG. 4, reflex dome 28 is preferably dome-shaped, with its apex extending outwardly from loudspeaker apparatus 10 and its rim facing the mounting bracket 12. This configuration allows reflex dome 28 to be driven by a voice coil attached to its rim rather than its apex. Accordingly, a larger and more powerful voice coil can be utilized to drive the reflex dome, thus providing a more transient frequency response.

As best illustrated in FIG. 3, reflex dome 28 includes a plurality of critical pressure loading vents 40 along its outer dome surface. Critical pressure loading vents 40 perform two primary functions: 1) they reduce loudspeaker sound cancellation by allowing some of the back radiation from reflex domes 28 to emerge in phase with the front radiation; and 2) they draw air into loudspeaker 10 when reflex domes 28 are flexed outward, thus creating a high pressure zone in the interior of loudspeaker 10. The high pressure zone increases the bass response of loudspeaker 10 and eliminates the need for an enclosure or baffle.

Critical pressure loading vents 40 can be any shape, but are shown rectangular. Those skilled in the art will appreciate that the resonance characteristics of reflex dome 28 can be altered by varying the size and shape of the critical pressure loading vents 40.

Figure 5:
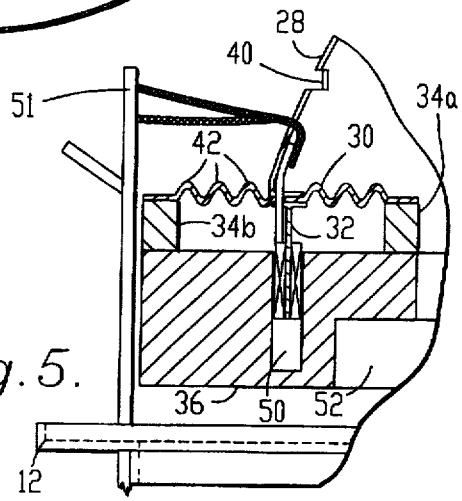
FIG. 5 is a partial section view illustrating the suspension of the voice coil adjacent the magnet in the first embodiment.

Accordion edge suspension 30 is provided for suspending the rim of reflex dome 28 adjacent magnet 18 as best illustrated in FIG. 5. This suspension allows reflex dome 28 to vibrate about the axis of bracket 12 for producing sound waves in response to variations in the electrical signal applied to the loudspeaker's voice coil 32 as discussed below.

Returning to FIG. 4, accordion edge suspension 30 is essentially ring-shaped and presents inner and outer circumferential edges and upper and lower axial faces. Accordion edge suspension 30 also includes a plurality of accordion-shaped channels 42 extending between the inner and outer circumferential edges. Channels 42 allow suspension 30 to move in a linear fashion along its axis.

The upper axial face of accordion edge suspension 30 is attached to the rim of reflex dome 28, and the lower axial face is attached to inner and outer suspension towers **34*a* and 34*b* and to loudspeaker voice coil 32. With this configuration, accordion edge suspension 30 dampens the oscillations of voice coil 32**.

Voice coil 32 is provided for driving reflex dome 28 and includes a ring-shaped former 44 and a length of electrically conductive wire 46 as illustrated in FIG. 4. The former 44 presents upper and lower axial ends and is preferably formed of a non-conductive plastic material and presents a diameter approximately equal to the diameter of the rim of reflex dome 28. Wire 46 is 8 ohm or 4 ohm enameled copper wire small-gauge conductive cable and is wound on the perimeter of former 44. The ends of the wire extend from central core 44 and are attached to input terminals 51 for connection to a source of alternating current.

As best illustrated in FIG. 5, one axial end of voice coil 32 is attached to accordion edge suspension 30 and the other axial end is freely suspended adjacent the loudspeaker's magnetic flux ring 36. With this construction, voice coil 32 vibrates reflex dome 28 when subjected to an alternating current as described below.

Inner and outer suspension towers **34*a* and 34*b* are provided for supporting accordion edge suspension 30 above magnetic flux ring 36. This allows accordion edge suspension 30 to suspend voice coil 32 in flux groove 50 of magnetic flux ring 36 as described in detail below. Inner and outer suspension towers 34*a* and 34*b*** are preferably formed of plastic or other non-conductive material and are essentially ring-shaped.

As best illustrated in FIG. 5, the inside diameter of inner suspension tower **34*a* is approximately equal to the inside diameter of the magnet assembly, and the outside diameter of outer suspension tower 34*b* is approximately equal to the outside diameter of the magnet assembly. The upper axial edges of suspension towers 34*a* and 34*b* are fixedly attached to the accordion edge suspension 30, and the lower axial edges are fixedly attached to magnetic flux ring 36. With this arrangement, suspension towers 34*a* and 34*b* cooperate to suspend voice coil 32 in magnetic flux grove 50**.

Magnetic flux ring 36 is provided for producing a directional magnetic flux extending along its axis in response to a magnetic field provided by a magnet 18. Magnetic flux ring 36 is preferably formed of carbon steel and is essentially ring-shaped. As best illustrated in FIG. 4, magnet flux ring 36 presents opposed upper and lower axial ends 48 and 49. Upper axial end 48 includes a circular flux groove 50 for receiving voice coil 32. Lower axial end 49 includes a stepped portion 52 for receiving magnet 18 as described below.

Magnet 18 is provided for magnetizing the carbon steel flux rings 36 of both diaphragm assemblies 14 and 16. As best illustrated in FIG. 3, magnet 18 is positioned in stepped portion 52 formed in each carbon steel flux ring 36. Magnet 18 magnetizes flux rings 36 and produces a radial magnetic flux in flux grooves 50 of both magnetic flux rings 36. Magnet 18 is preferably a permanent magnet that produces desired flux density.

In operation, first and second diaphragm assemblies 14 and 16 radiate sound in a 360 degree direction. Magnet 18 magnetizes both carbon steel radial magnet flux rings 36, thus inducing a radial magnetic flux in their flux grooves 50. An alternating magnetic field is established around each voice coil 32 when an alternating electrical signal representative of music is applied to terminals 51. The interaction of the voice coil's 32 alternating magnetic field and magnet's 18 stationary magnetic field causes voice coil 32 to oscillate in and out of flux groove 50. Since voice coil 32 is rigidly attached to reflex dome 28, reflex dome 28 also oscillate. The oscillations of reflex dome 28 closely follows the variations in the applied electrical signal and sets up sound waves.

Since first and second diaphragm assemblies 14 and 16 are positioned on opposed sides of magnet 18, they are positioned in magnetic fields of opposite polarity. To prevent the opposed reflex dome 28 from vibrating out of phase, the polarities of the alternating electrical signals applied to terminals 51 of each diaphragm assembly should be reversed. In this way, diaphragm assemblies 14 and 16 will be in-phase and isobaric loudspeaker 10 will operate as a true isobaric loudspeaker.

II. Embodiment of FIGS. 6–10

A second preferred isobaric loudspeaker 100 is illustrated in FIGS. 6–10. Isobaric loudspeaker 100 is designed for optimally reproducing the mid-range or mid-bass audio frequencies and broadly includes a pair of diaphragm assemblies 114 and 116, a mounting bracket 112 for mounting diaphragm assemblies 114 and 116 in an opposed relationship, and magnet assembly 118 positioned between diaphragm assemblies 114 and 116 for providing a magnet flux in the vicinity of both diaphragm assemblies 114 and 116.

Figure 9:
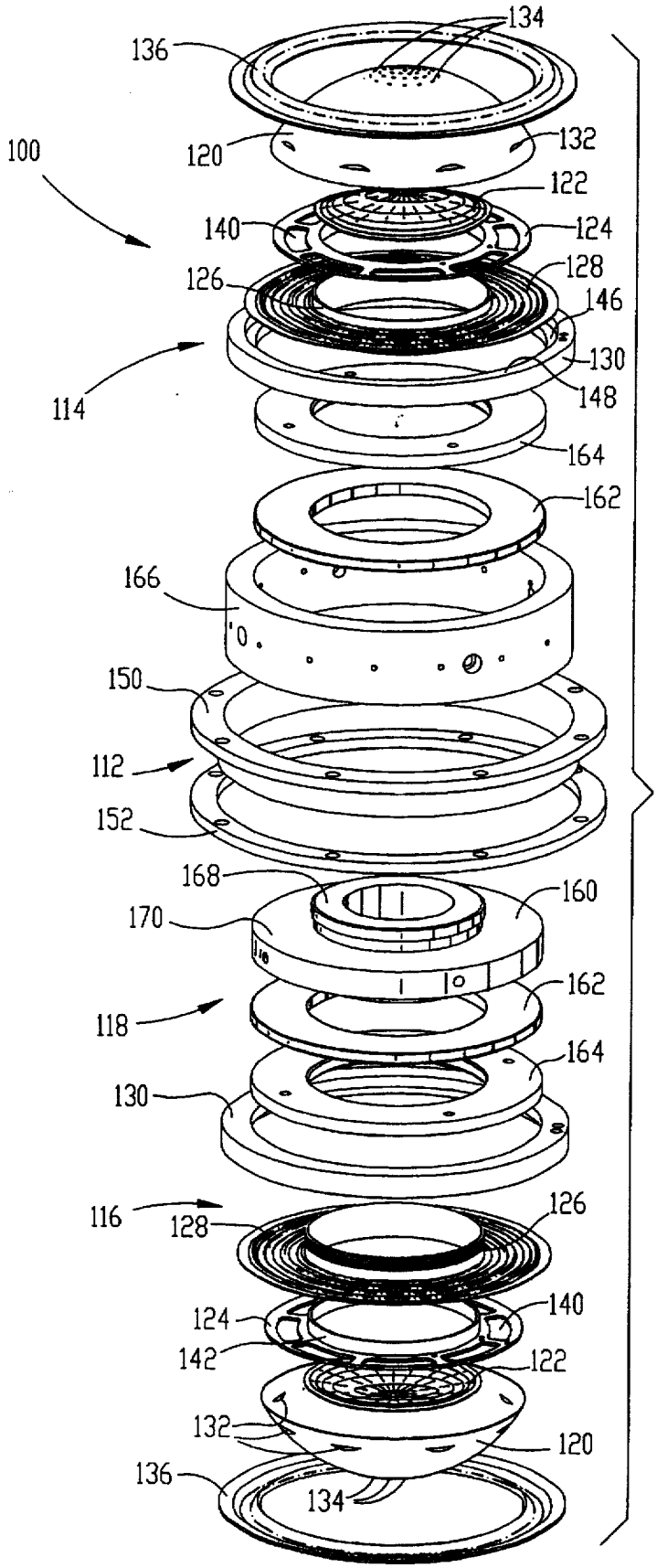
FIG. 9 is an exploded view of the loudspeaker apparatus of the second embodiment.

As illustrated in more detail in FIG. 9, each diaphragm assembly 114 and 116 includes outer diaphragm 120, inner diaphragm 122, diaphragm mounting plate 124, voice coil 126, spider gear 128, and suspension tower 130. In preferred forms, the components of each diaphragm assembly 114 and 116 are substantial identical, thus only one diaphragm assembly is described in detail herein.

Outer diaphragm 120 is provided for setting up sound waves in response to the vibration of voice coil 126 as described below. As best illustrated in FIG. 6, outer diaphragm 120 is dome-shaped, with its apex extending outwardly from loudspeaker apparatus 100 and its rim facing mounting bracket 112. Outer diaphragm 120 can be formed of a variety of materials.

As best illustrated in FIG. 8, outer diaphragm 120 includes a plurality of critical pressure loading vents 132 and loading holes 134 spaced along its domed surface. Loading vents 132 are preferably concave-shaped slots formed between the apex and rim of outer diaphragm 120. Loading holes 134 are preferably circular in shape and are formed at the apex of outer diaphragm 120. Critical pressure loading vents 132 and holes 134 are provided for reducing loudspeaker sound cancellation and for drawing air into the loudspeaker for creating a high pressure zone in the loudspeaker.

Inner diaphragm 122 is provided for both setting up sound waves in response to vibration of voice coil 126 and for increasing the air pressure within the interior of loudspeaker apparatus 100 as described in more detail below. The addition of inner diaphragm 122 improves the mid-range frequency response of loudspeaker apparatus 100 without inhibiting lower frequency response and without introducing excessive air noise through critical pressure loading vents 132 and loading holes 134.

Returning to FIG. 8, inner diaphragm 122 is positioned within outer diaphragm 120 and is also preferably dome-shaped and formed of a variety of materials. Inner diaphragm 122 may also include a plurality of critical pressure loading vents and loading holes similar to those formed on outer diaphragm 120.

Diaphragm mounting plate 124 couples outer diaphragm 120 and inner diaphragm 122 to voice coil 126. By providing diaphragm mounting plate 124 rather than coupling outer diaphragm 120 and inner diaphragm 122 directly to voice coil 126, the diaphragms 120 and 122 can be sized independently of voice coil 126. Thus, larger diaphragms can be used with conventional sized voice coils.

As best illustrated in FIG. 9, diaphragm mounting plate 124 is preferably ring-shaped and presents inner and outer circumferential edges and upper and lower axial faces. A plurality of air slots 140 extend through the axial faces for providing a path of travel for the delivery of concentrated air from the center of speaker 100 to outer diaphragm 120.

Inner diaphragm 122 is secured to the inner circumferential edge of diaphragm mounting plate 124, and outer diaphragm 120 is secured to the outer circumferential edge of diaphragm mounting plate 124. The lower axial face of diaphragm mounting plate 124 is then fixedly secured to voice coil 126 for transferring movement from voice coil 126 to outer diaphragm 120 and inner diaphragm 122.

As best illustrated in FIG. 8, diaphragm mounting plate 124 also includes annular lip portion 142 that extends transverse to its upper and lower axial faces. Lip portion 142 is provided for engaging and maintaining the round shape of voice coil 126, thus increasing the linearity of loudspeaker apparatus 100. Diaphragm mounting plate 124 also provides an area for attachment of a foam-rolled suspension 136.

Voice coil 126 is provided for driving outer diaphragm 120 and inner diaphragm 122 and includes a non-conductive ring-shaped former and a length of electrically conductive wire. As best illustrated in FIG. 8, one axial edge of voice coil 126 is secured to diaphragm mounting plate 124, and the other axial edge is freely suspended adjacent magnet assembly 118 as described in more detail below. The conductive wire for each voice coil 126 is coupled with two sets of input terminals 144. One set of input terminals 144 allow the diaphragm assemblies 114 and 116 to be operated in-phase. The other set of input terminals 144 allow the diaphragm assemblies 114 and 116 to be operated either out of phase or independently of one another.

Spider gear 128 suspends voice coil 126 adjacent magnet assembly 118. As best illustrated in FIG. 9, spider gear 128 is essentially ring-shaped and presents inner and outer circumferential edges. The inner circumferential edge is secured to voice coil 126 and the outer circumferential edge is secured to suspension tower 130 as described below. Spider gear 128 includes a plurality of accordion-shaped channels extending between its inner and outer circumferential edges for increasing its flexibility.

Suspension tower 130 supports spider gear 128 and foam-rolled suspension 136 and thus suspends voice coil 126, outer diaphragm 120, and inner diaphragm 122 adjacent magnet assembly 118. As best illustrated in FIG. 9, suspension tower 130 is preferably ring-shaped and includes an inner stepped portion 146 and an outer stepped portion 148. Inner stepped portion 146 supports the outer circumferential edge of spider gear 128, whereas outer stepped portion 148 supports outer circumferential edge of foam-rolled suspension 136.

Mounting bracket 112 is provided for mounting diaphragm assemblies 114 and 116 in an opposed relationship and preferably includes central bracket 150 and a keeper ring 152. Central bracket 150 and keeper ring 152 are both preferably ring shaped and formed of aluminum. As illustrated in FIG. 7, a plurality of screw or bolt holes 154 are formed through the axial faces of central bracket 150 and keeper ring 152 for receiving conventional bolts or screws for coupling loudspeaker apparatus 100 to a backboard or mounting plate.

Magnet assembly 118 is provided for producing a stationary magnet flux in the vicinity of both diaphragm assemblies 114 and 116. The stationary magnetic flux then interacts with the alternating magnetic field set up around voice coils 126 for vibrating or oscillating voice coils 126. As best illustrated in FIG. 9, magnet assembly 118 is positioned between diaphragm assemblies 114 and 116 and includes a single magnetic pole piece 160, a pair of ring magnets 162, a pair of magnetic top plates 164, and an outer aluminum housing 166.

Magnetic pole piece 160 provides the primary source of magnetic flux for magnet assembly 118 and includes an inner ring portion 168 and an integral outer annular flange 170. Outer annular flange 170 presents upper and lower annular faces for supporting ring magnets 162 as described in more detail below.

As best illustrated in FIG. 8, inner ring portion 168 presents an inner circumferential edge that defines a hollow high pressure bore or chamber 172. High pressure chamber 172 extends between diaphragm assemblies 114 and 116 and presents a diameter of approximately 2"–4" inches. High pressure chamber 172 allows air flow between diaphragm assemblies 114 and 116 and thus improves the frequency response of loudspeaker apparatus 100 without the typical distortion experienced by conventional sub-woofer loudspeakers.

High pressure chamber 172 and inner diaphragm 122 cooperate for creating greater air pressure near the center of the loudspeaker 100. This high pressure zone improves the frequency response of the 100 loudspeaker while reducing air noise through critical pressure loading vents 132 and holes 134. The high pressure zone also eliminates the need for an enclosure or baffle.

Magnetic pole piece 160 is preferably formed of carbon steel, and permanent magnet is formed of Neodynium 35. Applicant has discovered that this combination magnetic pole piece Neodynium 35 can produce a flux density of 16,000 Gauss, even with the large diameter high pressure chamber 172. Thus, by constructing magnetic pole piece in this fashion, the high pressure chamber 172 can be formed in the loudspeaker apparatus 100 without the loss of magnetic flux density. In contrast conventional sub-woofer loudspeakers require a central pole piece with a solid central core to obtain adequate flux density.

Returning to the discussion of the present invention, Neodynium ring magnets 162 are provided for enhancing the magnetic flux in the vicinity of voice coils 126 and are preferably formed of Neodynium 35. As best illustrated in FIG. 8, each ring magnet 162 is placed adjacent one of the axial faces of outer annular flange 170. Each ring magnet 162 presents an inside diameter slightly greater than the outside diameter of the inner ring portion 168 of magnetic pole piece 160. Thus, the space between each ring magnet 162 and inner ring portion 168 defines a radial magnetic flux groove 161 adjacent magnetic pole piece 160 for receiving the lower radial edge of voice coil 126 during operation of loudspeaker apparatus 100.

Magnetic top plates 164 cover the exposed faces of ring magnets 162 for enhancing the magnetic flux in the vicinity of the flux grooves. Each top plate 164 is ring-shaped and is preferably formed of steel.

Outer housing 166 is provided for encasing the other components of magnet assembly 118 and for supporting suspension towers 130. As best illustrated in FIG. 9, outer housing 166 is ring-shaped and presents a pair of inner and outer circumferential sidewalls and a pair of opposed axial end walls. The inner circumferential sidewall presents an inside diameter equal to or slightly greater than the outside diameters of ring magnets 162, top plates 164 and outer annular flange 170 of pole piece 166. Thus, as illustrated in FIG. 8, outer housing 166 circumscribes these components.

Figure 10:
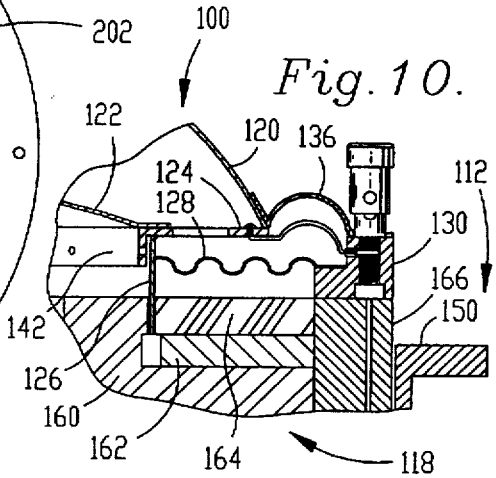
FIG. 10 is a partial section view illustrating the suspension of the voice coil in the second embodiment.

As best illustrated in FIG. 10, the axial end walls of outer housing 166 support suspension towers 130, which are secured thereto with screws or other conventional fasteners. Outer housing 166 also includes a plurality of screw holes and taps along its outer circumferential edge for receiving screws for attachment to mounting bracket 112. Outer housing 166 is preferably formed of anodized aluminum to prevent corrosion.

OPERATION

The second embodiment of the isobaric loudspeaker apparatus 100 operates similar to the first embodiment except for the addition of the high pressure chamber 172 and inner diaphragm 122. The high pressure chamber 172 and inner diaphragm 172 cooperate for creating a high air-pressure zone between opposed speaker assemblies 114 and 116. This high pressure zone improves the frequency response of loudspeaker apparatus 100 without increased distortion.

III. Embodiment of FIGS. 11–13

Figure 11:
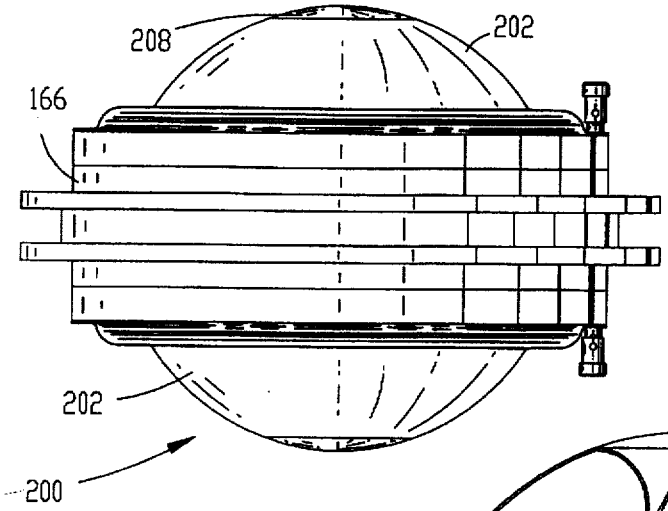
FIG. 11 is a side view of an isobaric loudspeaker apparatus constructed in accordance with a third preferred embodiment of the invention.
Figure 13:
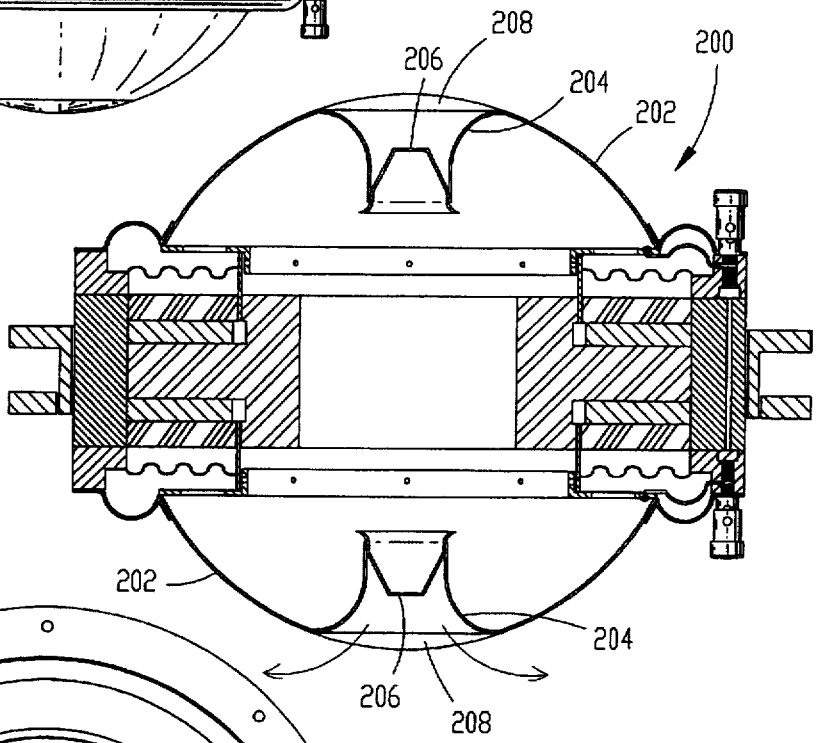
FIG. 13 is a side section view of the loudspeaker apparatus of the third embodiment.
Figure 12:
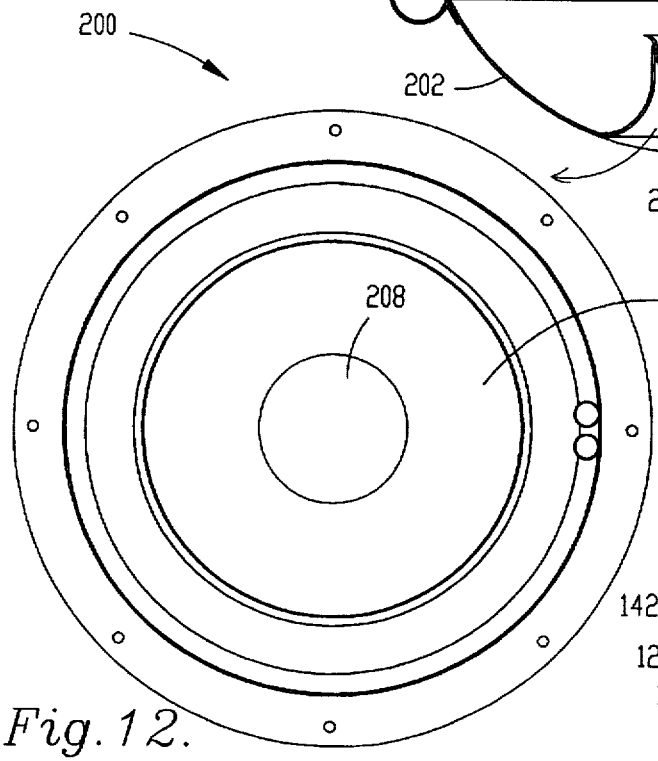
FIG. 12 is a top view of the loudspeaker apparatus of the third embodiment.

A third preferred isobaric loudspeaker apparatus 200 is illustrated in FIGS. 11–13. Isobaric loudspeaker 200 is designed for optimally reproducing high-range audio frequencies and is substantially identical to the second embodiment of the loudspeaker apparatus except for the design of the diaphragms. Accordingly, only the components of speaker apparatus 200 that are different than speaker apparatus 100 are discussed in detail herein and numbered in the drawing figures.

Applicant has discovered that dome-shaped outer and inner diaphragms provide excellent 360 degree sound dispersion, but lack sound compression abilities in higher frequencies. To overcome this problem while retaining the advantages of the sound reproduction characteristics of the isobaric design, isobaric loudspeaker 200 eliminates the inner diaphragm and includes a novel outer diaphragm 202.

In more detail, each outer diaphragm 202 includes a funnel-shaped vortex 204 and a fluted reed device 206. Funnel-shaped vortex 204 is integrally formed with the outer diaphragm 202 near its apex and extends inwardly towards the high pressure chamber of the magnet assembly. Funnel-shaped vortex 204 channels sound out of the loudspeaker apparatus 200 and thus improves the loudspeaker's compression and dispersion when reproducing higher audible frequencies.

Fluted reed device 206 is provided to maintain the air pressure within the high pressure chamber of the magnet assembly and to add rigidity to funnel-shaped vortex 204. Each fluted reed device 206 is a cup-like member preferably formed of the same material as the outer diaphragm 202 and fits within the stem of its respective funnel-shaped vortex 204. As best illustrated in FIG. 13, each fluted reed device 206 includes an outwardly extending lip portion for frictionally engaging the lowermost edge of its respective funnel-shaped vortex 204.

The second embodiment of loudspeaker apparatus may 200 also include dust cap 208 for covering the funnel-shaped portions of outer diaphragm 202.

IV. Embodiment of FIGS. 14–16

A fourth preferred isobaric loudspeaker 300 is illustrated in FIGS. 14–16. Isobaric loudspeaker 300 is designed for optimally reproducing the low-range or bass audio frequencies and is substantially identical to the second embodiment of the loudspeaker apparatus except for the design of the diaphragms. In more detail, isobaric loudspeaker 300 does not include the inner diaphragms and critical pressure loading holes on the outer diaphragm.

Although the invention has been described with reference to the preferred embodiment illustrated in the attached figures, it is noted that equivalents may be employed and substitutions made herein without departing from the scope of the invention as recited in the claims. For example, although the preferred embodiment of the invention has been described as a low-frequency loudspeaker, the diaphragms or reflex domes may be formed in a variety of shapes and constructed of a variety of materials to alter the frequency range of the loudspeakers.

Particularly, although the preferred diaphragms or reflex domes are dome-shaped, they may be formed in a variety of shapes to enhance the frequency crossover capabilities of the isobaric loudspeaker. Other exemplary shapes include concave, cone-shaped, isometric, or geometric. Accordingly, a mid-range or high-range loudspeaker can be constructed using the teachings of the present invention.

Moreover, although the diaphragms or reflex domes of the first and second diaphragm assemblies are shown as being substantially identical, they may be sized and shaped independently of one another to allow the diaphragm assemblies to cover distinct frequency ranges. Additionally, the diaphragms or reflex domes may be driven by voice coils operating at different frequencies. For example, the reflex dome of the first diaphragm assembly may be driven by a voice coil configured to cover the low bass frequencies, whereas the reflex dome of the second diaphragm assembly may be driven by a voice coil configured to cover the low to mid-range frequencies. As a result, the isobaric loudspeaker can be configured to provide superior frequency crossover capabilities.

The transition between frequency ranges may also be enhanced by varying the material in the reflex domes. For example, the reflex dome of the first diaphragm assembly could be formed of polypropylene, whereas the reflex dome of the second diaphragm assembly could be formed of polyurethane. This arrangement would also improve the crossover capabilities of the loudspeaker.

Having thus described the preferred embodiment of the invention, what is claimed as new and desired to be secured by Letters Patent is:

1. A loudspeaker comprising:

a pair of domed-shaped diaphragm assemblies each including an outer diaphragm and a voice coil for driving said outer diaphragm;

mounting means for mounting said diaphragm assemblies in an opposed relationship so that said outer diaphragms extend in opposite directions; and a magnet assembly positioned between said diaphragm assemblies for providing a magnetic flux in the vicinity of both of said diaphragm assemblies, said magnet assembly including a pair of magnetic flux rings each positioned adjacent one of said diaphragm assemblies for producing a directional magnetic flux in the vicinity of its respective voice coil when said magnetic flux rings are magnetized, and only one radial magnet positioned between said magnetic flux rings for magnetizing said magnetic flux rings for producing a radial magnetic flux in the vicinity of said diaphragm assemblies.

2. The loudspeaker as set forth in claim 1, said diaphragm assemblies each further including an inner diaphragm positioned within said outer diaphragm.

3. The loudspeaker as set forth in claim 2, wherein said outer and inner diaphragms are dome-shaped.

4. The loudspeaker as set forth in claim 3, said outer diaphragms each including an integral funnel-shaped vortex extending inwardly towards said inner diaphragms.

5. The loudspeaker as set forth in claim 1, said magnetic pole piece presenting inner and outer circumferential sidewalls and axially opposed faces extending therebetween, said inner circumferential sidewall defining said passageway.

6. The loudspeaker as set forth in claim 2, each of said diaphragm assemblies further including a ring-shaped diaphragm mounting plate secured to said voice coil, said diaphragm mounting plate presenting an outer circumferential edge for coupling with said outer diaphragm and an inner circumferential edge for coupling with said inner diaphragm.

7. The loudspeaker as set forth in claim 1, each of said diaphragm assemblies further including a spider gear secured to said voice coil for suspending said voice coil in the vicinity of said magnetic flux.

8. The loudspeaker as set forth in claim 7, each of said diaphragm assemblies further including a suspension tower for supporting said spider gear adjacent said magnet assembly for freely suspending said voice coil in the vicinity of said magnetic flux.

9. The loudspeaker as set forth in claim 1, wherein said outer diaphragms each include a plurality of slots for allowing air movement therethrough during vibration of said dome.

10. The loudspeaker as set forth in claim 1, including means for delivering current simultaneously to both of said voice coils so that said diaphragm assemblies operate in-phase with one another.

11. The loudspeaker as set forth in claim 10, said loudspeaker including means for delivering opposite polarity current to said voice coils so that said diaphragm assemblies operate out of phase with one another.

12. The loudspeaker as set forth in claim 11, said loudspeaker including means for selectively delivering current to only one of said voice coils at a time so that said diaphragm assemblies can be selectively operated independently of one another.

13. The loudspeaker as set forth in claim 3, wherein said inner and outer dome-shaped diaphragms are formed of polypropylene.

14. The loudspeaker as set forth in claim 1, said outer diaphragms each having an outermost rim, said voice coils being mounted directly to said diaphragm rims.

15. A loudspeaker comprising:

a pair of domed-shaped diaphragm assemblies each including an outer diaphragm and a voice coil for driving said outer diaphragm;

mounting means for mounting said diaphragm assemblies in an opposed relationship so that said outer diaphragms extend in opposite directions; and a magnet assembly positioned between said diaphragm assemblies for providing a magnetic flux in the vicinity of both of said diaphragm assemblies, said magnet assembly including a single, hollow ring-shaped magnetic pole piece having an axial passageway extending between said diaphragm assemblies for permitting air to pass between said outer diaphragms, and a pair of ring-shaped magnets positioned on opposite sides of said magnetic pole piece.

* * * * *